US007404700B1

(12) United States Patent
Spanks, Jr.

(10) Patent No.: US 7,404,700 B1
(45) Date of Patent: Jul. 29, 2008

(54) TURBINE AIRFOIL WITH FIBROUS REINFORCED TBC

(75) Inventor: William A. Spanks, Jr., Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 440 days.

(21) Appl. No.: 11/337,880

(22) Filed: Jan. 21, 2006

Related U.S. Application Data

(60) Provisional application No. 60/716,577, filed on Sep. 12, 2005.

(51) Int. Cl.
*F01D 5/14* (2006.01)

(52) U.S. Cl. ..... 416/241 R; 416/241 A

(58) Field of Classification Search ..... 416/230, 416/241 R; 428/630, 631, 632, 221
See application file for complete search history.

(56) References Cited

U.S. PATENT DOCUMENTS 5,951,254 A * 9/1999 Sikorski et al. ..... 416/224
2007/0292616 A1* 12/2007 Hazel ..... 427/337

* cited by examiner

*Primary Examiner*—Edward Look
*Assistant Examiner*—Dwayne J White

(57) ABSTRACT

An airfoil used in a gas turbine engine exposed to high temperatures, the airfoil having a TBC layer that includes fibers of reinforcing material to add strength to the layer of TBC. The fibers are made from a similar material in which the airfoil is made from to withstand the high temperatures, and have a diameter of about 0.1 mm in order that a thin layer of TBC can completely cover and embed the fibers within the layer.

7 Claims, 1 Drawing Sheet

TURBINE AIRFOIL WITH FIBROUS REINFORCED TBC

CROSS-REFERENCE TO RELATED APPLICATIONS

This application claims the benefit to an earlier filed Provisional Application Ser. No. 60/716,577 filed on Sep. 12, 2005 and entitled TURBINE AIRFOIL WITH FIBROUS REINFORCED TBC.

BACKGROUND OF THE INVENTION

1. Field of the Invention

The present invention relates generally to a gas turbine engine, and in particular, to a TBC coating on an air cooled blade or vane in a gas turbine engine.

2. Description of the Related Art Including Information Disclosed Under 37 CFR 1.97 and 1.98

In a gas turbine engine, the blade and vanes in the turbine section are exposed to the highest temperatures in the engine. It is these parts which limit the operating temperature of the gas turbine engine. Higher efficiency is obtained with a higher operating temperature. However, modern materials are limited to operating temperatures below the melting temperature of the material. Air cooling of the blades has been used to allow for higher turbine temperatures without raising the melting temperature of the blades. Thermal Barrier Coatings (or, TBC) have been used on surfaces of the blade exposed to the highest temperatures to further increase the operating temperature of the turbine. TBCs are thin coatings of high temperature resistant ceramic materials that act to block the high temperatures from harming the blade material. TBCs are generally thin of about 1 mm in thickness, and are brittle. Examples of Prior Art TBCs are disclosed in U.S. Pat. No. 6,933,052 issued to Gorman et al, U.S. Pat. No. 6,890,668 issued to Bruce et al, U.S. Pat. No. 6,730,413 issued to Schaeffer et al, U.S. Pat. No. 6,686,060 issued to Bruce et al, U.S. Pat. No. 6,548,190 issued to Spitsberg et al, U.S. Pat. No. 6,485,848 issued to Wang et al, U.S. Pat. No. 6,465,090 issued to Stowell et al, and U.S. Pat. No. 6,444,335 issued to Wang et al, all of which are incorporated herein by reference.

It is desirable to make the TBC layer thicker in order to provide more protection to the airfoil surface from the high temperatures. A thicker TBC layer would allow for higher gas turbine temperatures, leading to improved efficiency of the engine. However, when the TBC layer gets too thick, pieces start to spall or chip off and eventually the underlining airfoil base material is exposed to the high gas stream temperature due to lack of TBC protection. It is therefore desirable to provide for a thicker TBC layer on an airfoil used in the high temperature regions of a gas turbine engine.

BRIEF SUMMARY OF THE INVENTION

The present invention is directed to an airfoil used in the turbine section of a gas turbine engine, in which the airfoil includes a TBC layer to protect the base metal from the extreme high temperatures occurring in the turbine, in which the TBC layer includes metal fibrous reinforcements embedded in the TBC layer to provide reinforcement such that the TBC layer can be thicker than a non-fibrous reinforced layer, and therefore allow for a higher turbine temperature. The fibers are about 0.1 mm in diameter, and are made from nickel, cobalt, or iron based super alloys.

DETAILED DESCRIPTION OF THE INVENTION

Figure 1:
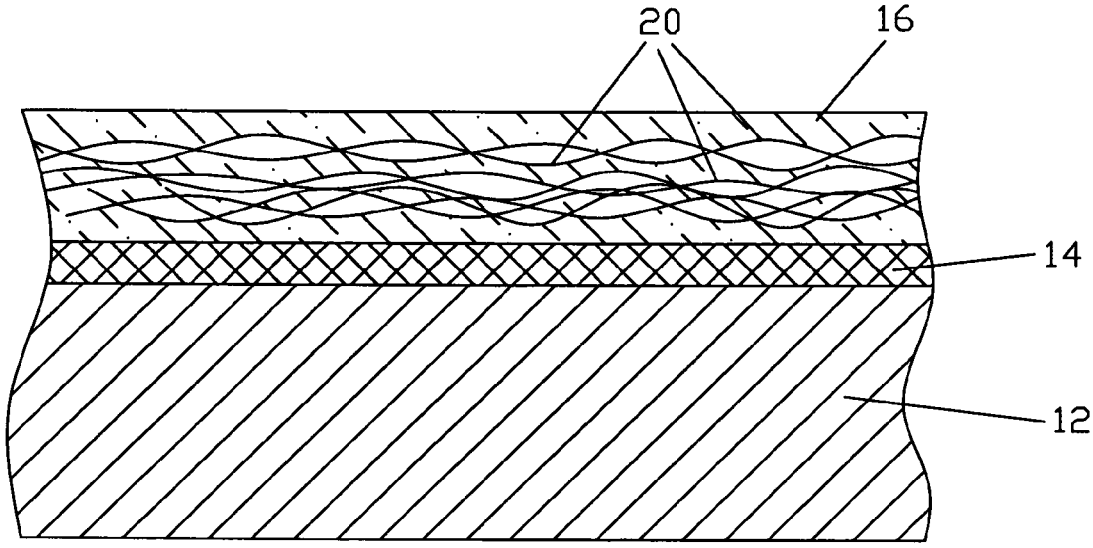
FIG. 1 shows a cross section of a portion of a turbine blade showing the TBC applied over a bond coat onto the substrate of the blade.

The present invention provides for a method of reinforcing the TBC on the blade so that the TBC will not spall or chip off of the blade surface and therefore expose the blade surface to high temperatures above the safe operating range of the blade material. The fibers act to strengthen the TBC properties in tension and reduce the chance for a spalled piece to break off from the TBC layer. FIG. 1 shows the present invention, in which a blade substrate 12 includes a bond coat 14 applied onto the substrate and a TBC 16 applied over the bond coat 14. This is the standard method of using a TBC on a turbine blade or vane. The TBC is generally about 1 mm in thickness. The present invention includes a plurality of metallic fibers 20 intertwined over the surface of the bond coat 14. The metallic fibers 20 can be applied in a weave such as in fibrous laminated composite materials, or placed onto the bond coat 14 surface by wrapping a string of the fibers around the airfoil. The TBC is then applied over the fibers 20 and allowed to harden. When hardened, the metallic fibers 20 provide a strong reinforcement to the TBC to prevent spalling of the TBC during operations.

A material for the fibers 20 is the same as the blade substrate. A high temperature resistant material is preferred. Substrate—and, therefore fiber—materials include nickel, cobalt, or iron based super alloys. The alloys can be cast or wrought super alloys. Examples of such materials are GTD-111, GTD-222, Rene 80, Rene 41, Rene 125, Rene 77, Rene N4, Rene N5, Rene N6, $4^{th}$ generation single crystal super alloy—MX-4, Hastelloy, and cobalt based HS-188. The fibers 20 are preferably made of one of these materials as well because of the high temperature resistance and strength. The diameter of the fibers 20 are preferably 0.1 mm or less in order to allow for the TBC thickness to remain about 1 mm. the fibers 20 can be applied over the entire blade surface and a TBC applied over the fibers, or in selected surface areas of the blade because of costs associated with applying a TBC to the blade.

The fibers in the present invention are discussed with respect to a turbine blade. However, the invention could be applied to a turbine vane as well, since vanes also make use of TBCs in order to prevent damage due to high temperatures. It is also envisioned that the fibrous coating could also be applied to a harness coating used on machine elements such as bearings and shafts. Any coating that is applied by Prior Art techniques such as thermal spraying and plasma spraying can be applied over a fiber material to add strength to the coating.

The invention claimed is:

1. An airfoil used in a turbine section of a gas turbine engine, the airfoil including a TBC applied on the surface, the improvement comprising:

a fibrous reinforcement embedded in the TBC layer to provide reinforcement to the layer and prevent spalling.

2. The airfoil of claim 1 above, and further comprising:

the fibrous reinforcement having a diameter of substantially 0.1 mm.

3. The airfoil of claim 1 above, and further comprising:

the fibrous reinforcement material being the same material for which the airfoil substrate is made from.

4. The airfoil of claim 1 above, and further comprising:

the fibrous reinforcement being made of one or more of the following materials: GTD-111, GTD-222, Rene 80, Rene 41, Rene 125, Rene 77, Rene N4, Rene N5, Rene N6 $4^{th}$ generation single crystal supper alloy—MX-4, Hastelloy, or cobalt based HS-188.

5. A process of forming a TBC layer on an airfoil used in a gas turbine engine, the process comprising the steps of:

providing for an airfoil formed of a substrate;

applying a bond coat to the substrate;

placing a plurality of reinforcement fibers on the bond coat; and, applying a TBC layer over the fibers such that the fibers are completely embedded within the TBC layer.

6. The process of forming a TBC layer on an airfoil used in a gas turbine engine of claim 5, and further comprising the step of:

providing fibers that have a diameter of about 0.1 mm.

7. The process of forming a TBC layer on an airfoil used in a gas turbine engine of claim 5, and further comprising the step of:

providing for the fibers to be formed of one or more of GTD-111, GTD-222, Rene 80, Rene 41, Rene 125, Rene 77, Rene N4, Rene N5, Rene N6 $4^{th}$ generation single crystal supper alloy—MX-4, Hastelloy, or cobalt based HS-188.

* * * * *